US010665925B2

(12) United States Patent
Liu et al.

(10) Patent No.: US 10,665,925 B2
(45) Date of Patent: May 26, 2020

(54) ANTENNA APPARATUS AND METHOD WITH DIELECTRIC FOR PROVIDING CONTINUOUS INSULATION BETWEEN ANTENNA PORTIONS

(71) Applicant: Futurewei Technologies, Inc., Plano, TX (US)

(72) Inventors: Hongwei Liu, South Elgin, IL (US); Wee Kian Toh, San Diego, CA (US); Qinjiang Rao, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 506 days.

(21) Appl. No.: 15/411,898

(22) Filed: Jan. 20, 2017

(65) Prior Publication Data

US 2017/0324150 A1 Nov. 9, 2017

Related U.S. Application Data

(60) Provisional application No. 62/332,634, filed on May 6, 2016.

(51) Int. Cl.
*H01Q 1/24* (2006.01)
*H01Q 13/10* (2006.01)
(Continued)

(52) U.S. Cl.
CPC ..... *H01Q 1/243* (2013.01); *H01Q 5/35* (2015.01); *H01Q 5/357* (2015.01); *H01Q 13/10* (2013.01); *H01Q 21/28* (2013.01)

(58) Field of Classification Search
CPC ..... H01Q 1/243; H01Q 1/52; H01Q 1/521; H01Q 21/28; H01Q 3/24
See application file for complete search history.

(56) References Cited

U.S. PATENT DOCUMENTS 6,677,909 B2 1/2004 Sun et al.
7,705,795 B2 * 4/2010 Chiang ..... H01Q 1/2266 343/768
(Continued)

FOREIGN PATENT DOCUMENTS

CN 201946749 U 8/2011
CN 103401059 A 11/2013
(Continued)

OTHER PUBLICATIONS

Ravipati, C. B. et al., "The Goubau multi element monopole antenna—revisited," IEEE Antennas and Propagation Society International Symposium, 2007, pp. 233-236.
(Continued)

*Primary Examiner* — Ab Salam Alkassim, Jr.
(74) *Attorney, Agent, or Firm* — Fish & Richardson P.C.

(57) ABSTRACT

An apparatus is provided including a first antenna with a top face; a bottom face; and a periphery defined by an upper portion, a lower portion, and a pair of side portions. The first slot comprises a body, a first arm, and a second arm that divides the first antenna into a first portion, a second portion, a third portion, and a fourth portion. The first portion is larger than the third portion, and the third portion is larger than the second portion and the fourth portion. Further, the body of the first slot extends between the side portions of the periphery. Still yet, the first arm and the second arm extend between the body and one of the upper portion and the lower portion of the periphery. A dielectric is positioned in the first slot for providing continuous insulation between the first portion, the second portion, the third portion, and the fourth portion.

22 Claims, 10 Drawing Sheets

(51) Int. Cl.

| | |
|---|---|
| ***H01Q 21/28*** | (2006.01) |
| ***H01Q 5/35*** | (2015.01) |
| ***H01Q 5/357*** | (2015.01) |

(56) References Cited

U.S. PATENT DOCUMENTS

| | | | | |
|---|---|---|---|---|
| 9,966,655 | B2 * | 5/2018 | Li | H01Q 1/243 |
| 10,446,911 | B2 * | 10/2019 | Karilainen | H01Q 1/2266 |
| 2012/0052820 | A1 * | 3/2012 | Lin | H04B 1/3838 455/90.2 |
| 2013/0076579 | A1 * | 3/2013 | Zhang | H01Q 1/243 343/720 |
| 2013/0257659 | A1 | 10/2013 | Darnell et al. | |
| 2014/0125528 | A1 | 5/2014 | Tsai et al. | |
| 2014/0253406 | A1 | 9/2014 | Toh et al. | |
| 2015/0145744 | A1 * | 5/2015 | Kao | H01Q 9/0421 343/852 |
| 2015/0357700 | A1 * | 12/2015 | Kagaya | H01Q 1/1285 343/713 |
| 2016/0006293 | A1 * | 1/2016 | Jeong | G06F 1/1656 320/108 |
| 2016/0049734 | A1 * | 2/2016 | Kim | H01Q 13/16 343/702 |
| 2016/0056527 | A1 * | 2/2016 | Pascolini | G06K 9/00006 343/702 |
| 2016/0088130 | A1 * | 3/2016 | Jung | G06F 1/1626 455/575.1 |
| 2016/0218441 | A1 * | 7/2016 | Tian | H01Q 1/243 |
| 2016/0285153 | A1 * | 9/2016 | Li | H01Q 1/243 |
| 2017/0054196 | A1 * | 2/2017 | Hu | H01Q 1/243 |
| 2017/0117616 | A1 * | 4/2017 | Chen | H01Q 1/243 |
| 2017/0256843 | A1 * | 9/2017 | Hu | H01Q 1/243 |
| 2017/0307802 | A1 * | 10/2017 | Lim | G02B 6/0045 |
| 2017/0331196 | A1 * | 11/2017 | Wang | H01Q 1/38 |
| 2018/0181853 | A1 * | 6/2018 | Ennabli | H01Q 1/2225 |
| 2018/0358699 | A1 * | 12/2018 | Li | H01Q 1/243 |

FOREIGN PATENT DOCUMENTS

| | | | | |
|---|---|---|---|---|
| CN | 103682596 | A | 3/2014 | |
| CN | 204243174 | U | 4/2015 | |
| CN | 105428808 | A | 3/2016 | |
| JP | 2006310927 | A | 11/2006 | |
| WO | 2015028710 | A1 | 3/2015 | |
| WO | WO-2015081865 | A1 * | 6/2015 | H01Q 1/243 |
| WO | 2015177404 | A1 | 11/2015 | |

OTHER PUBLICATIONS

International Search Report and Written Opinion from PCT Application No. PCT/CN2017/081178, dated Jul. 17, 2017.

Office Action issued in Chinese Application No. 201780025433.4 dated Apr. 30, 2019, 7 pages.

Office Action issued in Japanese Application No. 2018-554681 dated Dec. 17, 2019, 10 pages (with English translation).

* cited by examiner

300

302

ANTENNA APPARATUS AND METHOD WITH DIELECTRIC FOR PROVIDING CONTINUOUS INSULATION BETWEEN ANTENNA PORTIONS

RELATED APPLICATION(S)

The present application claims priority to a provisional application filed on May 6, 2016, under Application Ser. No. 62/332,634, which is incorporated herein by reference in its entirety for all purposes.

FIELD OF THE INVENTION

The present invention relates to antennas, and more particularly to antennas configured for use with mobile devices.

BACKGROUND

Typically, mobile devices such as phones, tablets, etc. are equipped with the necessary infrastructure including circuitry, one or more antennas, etc. to accommodate long-range communications in the form of cellular communications. For aesthetic and/or functional design reasons, such antennas are typically hidden within or are formed as part of a housing of the mobile device. At the same time, there are growing bandwidth and efficiency demands on mobile device antenna designs, as cellular communication standards advance. For example, modern cellular communication standards require multiple-input-multiple output (MIMO) antenna configurations, carrier aggregation (CA) capabilities, etc. To this end, there are growing challenges in designing mobile device antennas to accommodate the foregoing design considerations.

SUMMARY

An apparatus is provided including a first antenna with a top face; a bottom face; and a periphery defined by an upper portion, a lower portion, and a pair of side portions. The first slot comprises a body, a first arm, and a second arm that divides the first antenna into a first portion, a second portion, a third portion, and a fourth portion. The first portion is larger than the third portion, and the third portion is larger than the second portion and the fourth portion. Further, the body of the first slot extends between the side portions of the periphery. Still yet, the first arm and the second arm extend between the body and one of the upper portion and the lower portion of the periphery. A dielectric is positioned in the first slot for providing continuous insulation between the first portion, the second portion, the third portion, and the fourth portion.

In additional embodiments, the first portion may be formed between the body, the upper portion and the pair of side portions of the periphery; the second portion may be formed between the body, the first arm, the lower portion and one of the pair of side portions of the periphery; the third portion may be formed between the body, the first arm, the second arm and the lower portion of the periphery; and the fourth portion may be formed between the body, the second arm, the lower portion and the other of the pair of side portion of the periphery.

In additional embodiments, the body may be linear or non-linear.

In additional embodiments, the first slot may include a third arm that divides the third portion into two portions.

In additional embodiments, a second antenna may be provided with a second slot comprising a second body, a fourth arm, and a fifth arm that divides the second antenna into a first portion, a fifth portion, a sixth portion, and a seventh portion. Further, the first portion may be larger than the sixth portion, and the sixth portion may be larger than the fifth portion and the seventh portion. Still yet, the second body of the second slot may extend between the side portions of the periphery. Moreover, the fourth arm and the fifth arm may extend between the body and the other of the upper portion and the lower portion of the periphery which is opposite to the one from which the first arm and the second arm extend. A dielectric may be positioned in the second slot for providing continuous insulation between the first portion, the fifth portion, the sixth portion, and the seventh portion. As an option, at least one switch may be provided for switching between a first mode operation for utilizing the first antenna, and a second mode operation for utilizing the second antenna.

In additional embodiments, the first portion may have a surface area that is 2 to 50 times of a surface of the second portion.

In additional embodiments, the apparatus may be configured for operating the antenna in a higher frequency band mode and a lower frequency band mode.

In additional embodiments, the third portion may have a surface area that is equal or bigger than a total surface of the second portion and the fourth portion.

In additional embodiments, the slot may have a width between 0.5-3.0 mm.

In additional embodiments, one or more ends of the slot may be electrically closed.

In additional embodiments, at least one fixed element may be in electrical communication with at least two of the first portion, the second portion, the third portion, and the fourth portion. Further, at least one antenna feed may be in electrical communication with at least two of the first portion, the second portion, the third portion, and the fourth portion. As an option, the fixed element may include at least one of a resistive element, a capacitive element, and an inductive element. Further, the at least one fixed element may include a fixed shunt. Still yet, each of the at least one antenna feed may include a head and a conductive piece. The head of the antenna feed may electrically communicate between the first portion and at least one of the second portion, the third portion and the fourth portion. Further, the conductive piece of the antenna feed may extend from the head of the antenna feed.

In additional embodiments, at least one configurable element may be in electrical communication with at least two of the first portion, the second portion, the third portion, and the fourth portion. Further, at least one antenna feed may be in electrical communication with at least two of the first portion, the second portion, the third portion, and the fourth portion. As an option, the at least one configurable element may include at least one of a resistive element, a capacitive element, and an inductive element. Further, the configurable element may include a switch. Still yet, each of the at least one configurable element may include a head that electrically communicates between at least two of the first portion, the second portion, the third portion and the fourth portion. As an option, one of the at least one configurable element may include a conductive piece that extends from the head of the configurable element. As an additional option, each of the at least one antenna feed includes a head and a conductive piece, wherein the head of the antenna feed may electrically communicate between the first portion and at least one of the second portion, the third portion and the fourth portion. Further, the conductive piece of the antenna feed may extend from the head of the antenna feed.

Also provided is a method for forming an antenna of an apparatus for wireless communication. A surface is created with a top face and a bottom face, wherein the surface has a periphery defined by an upper portion, a lower portion, and a pair of side portions. At least one slot is etched in the surface where the slot comprises a body, a first arm, and a second arm that divides the surface into a first portion, a second portion, a third portion, and a fourth portion. The first portion is larger than the third portion, and the third portion is larger than the second portion and the fourth portion. Further, the body of the at least one slot extends between the pair of side portions of the periphery. Still yet, the first arm and the second arm extend between the body and one of the upper portion and the lower portion of the periphery. A dielectric is injected in the slot for providing continuous insulation between the first portion, the second portion, the third portion, and the fourth portion.

To this end, in some optional embodiments, the antenna and the aforementioned slot/dielectric may serve as part of a metallically-housed mobile device without necessarily requiring one or more externally protruding antennas, while accommodating requirements of modern cellular communication standards including, but not limited to multiple-input-multiple output (MIMO) antenna configurations, carrier aggregation (CA) capabilities, etc. By its design, the antenna may serve to overcome various challenges in designing mobile device antennas and accommodate the foregoing design considerations. It should be noted that the aforementioned potential advantages are set forth for illustrative purposes only and should not be construed as limiting in any manner.

DETAILED DESCRIPTION

Figure 1A:
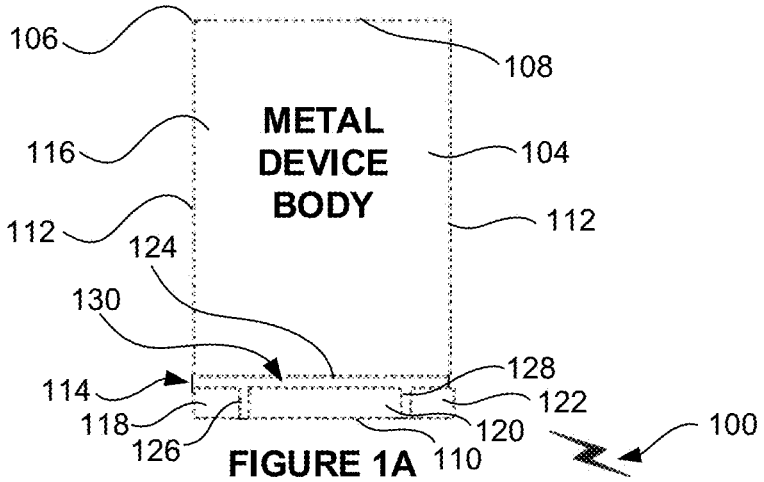
FIG. 1A illustrates an antenna, in accordance with one embodiment.

FIG. 1A illustrates an antenna 100, in accordance with one embodiment. As shown, the antenna 100 includes a top face 104, a bottom face (not shown), and a periphery 106. Such periphery 106 is defined by an upper portion 108, a lower portion 110, and a pair of side portions 112. The antenna 100 may be constructed using a conductive material. For example, in one embodiment, the antenna 100 may be constructed using a material that includes, at least in part, metal.

With continuing reference to FIG. 1A, a slot 114 is shown to be formed in the antenna 100. Such slot 114 divides the antenna 100 into a first portion 116, a second portion 118, a third portion 120, and a fourth portion 122. In one embodiment, the slot 114 may extend through the top face 104 and the bottom face of the antenna 100, so as to completely separate the different portions 116, 118, 120, 122. In another embodiment, at least one of the portions such as the first portion 116, etc. may serve as a ground plane during use. In various embodiments, the first portion 116 of the antenna 100 may be sized to have a larger surface area such as 2-50 times, etc. that of the second portion 118, the third portion 120, and the fourth portion 122, individually or collectively. Further, the third portion 120 of the antenna 100 may be sized to have a bigger surface area such as 1.25-20 times, etc. a total surface area of the second portion 118 and the fourth portion 122, individually or collectively. In additional embodiments, the third portion 120 of the antenna 100 may be sized to have a surface area equal to a total surface area of the second portion 118 and the fourth portion 122, individually or collectively.

In various embodiments, the third portion 120 may comprise over 50% of a total width of the antenna 100. Further, a width of the slot 114 (i.e. a distance between the different portions 116, 118, 120, 122) may be between 0.5% to 5% of the total width of the antenna 100. Still yet, in one embodiment, a size and/or shape of the second portion 118 and the fourth portion 122 may be the same or substantially the same. In other embodiments, the size and/or shape of the second portion 118 and the fourth portion 122 may be different and vary relatively, as desired. As will be described later, the antenna 100 may be configured for supporting multiple frequency bands including, but not limited to one or more lower bands such as 600-960 MHz, and one or more higher bands such as 1710-2700 MHz.

In one possible embodiment, the slot 114 may exhibit a uniform width along an entirety thereof. Of course, other embodiments are contemplated where the slot 114 has a non-uniform width. To this end, the slot 114 does not include conductive material, and thus results in the division of the antenna 100 into multiple portions.

With continuing reference to the exemplary embodiment shown in FIG. 1A, the slot 114 may include a first part 124 in the form of a body that extends between the side portions 112 of the periphery 106 of the antenna 100. Further, the first part 124 of the slot 114 may be linear or non-linear, such as curved. As will become apparent during the description of subsequent embodiments, any part of the slot 114 may be configured to have any shape. For example, the slot 114 may even zig-zag, and thus be comprised of multiple linear or non-linear parts that extend in different directions.

The slot 114 may further include a second part 126 (i.e. a first arm) that extends between the first part 124 of the slot 114, and the lower portion 110 of the periphery 106 of the antenna 100. Similar to the first part 124 of the slot 114, the second part 126 of the slot 114 may also be linear. Again, it should be noted that any part of the slot 114, including the second part 126 or subsequently described parts, may be configured to have any shape. As further shown in FIG. 1A, the second part 126 of the slot 114 may be perpendicular to the first part 124 of the slot 114.

The slot 114 also includes a third part 128 (i.e. second arm) that extends between the first part 124 of the slot 114, and the lower portion 110 of the periphery 106 of the antenna 100. Similar to the first part 124 and the second part 126 of the slot 114, the third part 128 of the slot 114 may also be linear or any other shape, for that matter. Further, similar to the second part 126 of the slot 114, the third part 128 of the slot 114 is perpendicular to the first part 124 of the slot 114, while remaining parallel to the second part 126 of the slot 114. To this end, the slot 114 may or may not be π-shaped. In the context of the present description, "π-shaped" refers to any shape that takes on a top and at least two legs to at least partially resemble the sixteenth letter of the Greek alphabet.

With continuing reference to FIG. 1A, a dielectric 130 is positioned in the slot 114 for providing continuous insulation between the first portion 116, the second portion 118, the third portion 120, and the fourth portion 122 of the antenna 100. Such dielectric 130 may take any form including, but not limited to an elastomeric material, ceramic, mica, glass, plastic, metal oxide, air, and/or any other material that is more insulative, as compared to metal. Further, it should be noted that the dielectric 130 may include any combination of different mixed or discretely positioned dielectrics.

Further, in the context of the present description, "continuous insulation" refers to any design whereby the dielectric 130 extends uninterrupted along a length of the slot 114 that divides the first portion 116, the second portion 118, the third portion 120, and the fourth portion 122 of the antenna 100. It should be noted that the dielectric 130 may or may not be uniform in width, shape, material, insofar as the continuous insulation is afforded. Further, as will be described in the context of subsequent embodiments, such continuous insulation may be provided, while still allowing a limited amount of conductivity between two or more of the portions 116, 118, 120, and/or 122 of the antenna 100. This, for example, may be accomplished using separate shunts, allowing a limited portion of the antenna 100 to remain when constructing the slot 114, and/or any other manufacturing technique that provides for such limited amount of conductivity. This may be done for any desired reason including, but not limited to altering a performance of the resultant antenna 100.

In one embodiment, the antenna 100 may serve as a mobile device housing component, and may thus operate as a conformal antenna. In one embodiment, a conformal antenna design refers to a design whereby a shape of an antenna follows or conforms to a surface or body of a mobile device such as a phone, etc. In context of the present description, such mobile device housing component may refer to any component of a mobile device housing which, in turn, may include any part of a mobile device that houses or supports at least some of the hardware that enables mobile device operation. Further, in different embodiments, the antenna 100, and thus the mobile device housing component, may be constructed, at least in part, using a metal material, and/or any other material that is at least partially conductive.

For example, in one embodiment, the antenna 100 may also serve as a back plate of a mobile device housing. In other embodiments, the mobile device housing component may include not only at least part of the back plate, but also at least part of a peripheral wall of the mobile device housing component. To that end, the top face 104 and bottom face may or may not be planar in design, and the periphery may or may not reside within the plane in which the top/bottom faces reside. For example, the periphery of the top face 104 and bottom face may be curved, may be part of a peripheral wall, etc. While the antenna 100 is shown to be rectilinear in shape, it should be noted that the antenna 100, and thus the mobile device housing component, may take on other shapes, such as oval. Further, in various embodiments, the mobile device may take the form of a phone, a personal data assistant (PDA), a tablet, a laptop, notebook, and/or any other type of device that is portable.

In use, the antenna 100 is configured for operating in a slot mode of operation. In the context of the present description, a slot mode of operation may refer to any mode of operation whereby an electric field extends across the slot 114. By this design, in some optional embodiments, the antenna 100 may be configured for supporting multiple frequency bands including, but not limited to one or more lower bands such as 600-960 MHz, and one or more higher bands such as 1710-2700 MHz. Further, the antenna 100 may be configured for supporting other advanced cellular protocol features such as multiple-input-multiple-output (MIMO) antenna operation, carrier aggregation (CA), etc., while providing at least a partially metalized mobile device housing with a compact form factor.

As an additional option, a width of the slot 114 may be configured to optimize antenna performance at certain frequencies. For example, the width may be selected to accommodate operating frequencies used in connection with advanced cellular protocol standards such as 4G, LTE, LTE-A, 5G and further advancements thereof, etc. In one particular embodiment, the width of the slot 114 may be between 0.5-3.0 mm. In other embodiments, such range may be widened to between approximately 10 mm up to 160 mm.

More illustrative information will now be set forth regarding various optional architectures and uses in which the foregoing method may or may not be implemented, per the desires of the user. Specifically, multiple variations of the antenna 100 will now be described. It should be noted that the following information is set forth for illustrative purposes and should not be construed as limiting in any manner. Any of the following features may be optionally incorporated with or without the exclusion of other features described.

Figure 1B:
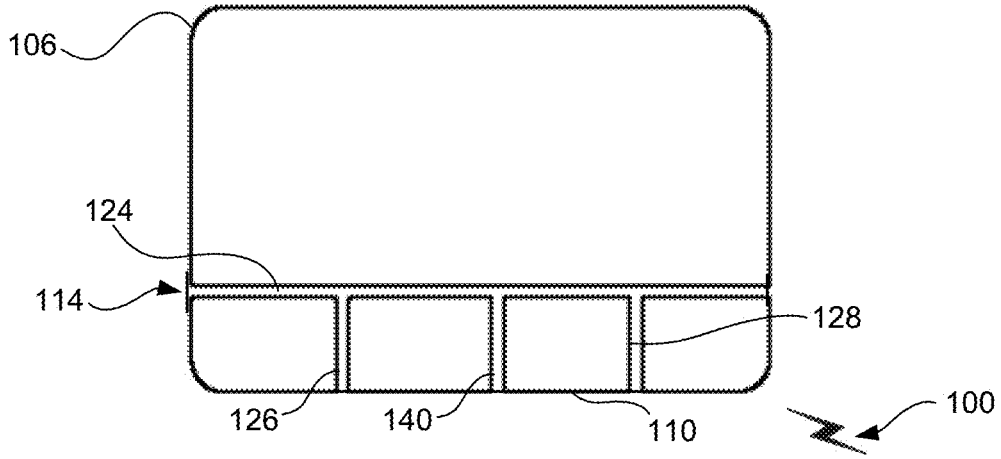
FIG. 1B illustrates the antenna of FIG. 1A with an additional slot part, in accordance with another embodiment.

FIG. 1B illustrates the antenna 100 of FIG. 1A with an additional slot part, in accordance with another embodiment.

As an option, the version of the antenna 100 of FIG. 1B may be implemented with one or more features of any one or more of the embodiments set forth in any previous and/or subsequent figure(s) and/or the description thereof. However, it is to be appreciated that the version of the antenna 100 of FIG. 1B may be implemented in the context of any desired environment. It should also be noted that only a bottom extent of the antenna 100 is shown in FIG. 1B and some subsequent figures, for simplicity.

As shown, the slot 114 of the antenna 100 includes a fourth part 140 that extends between the first part 124 and the lower portion 110 of the periphery 106 of the antenna 100. Similar to the first, second, and third parts 124, 126, 128 of the slot 114, the fourth part 140 of the slot 114 may also be linear. Again, it should be noted that any part of the slot 114 including the fourth part 140 may be configured to have any shape. As further shown in FIG. 1B, the fourth part 140 of the slot 114 may be perpendicular to the first part 124 of the slot 114, and parallel to the second part 126 and the third part 128 of the slot 114. The portion 120 of the antenna 100 in FIG. 1A is divided by the fourth part 140 into two portions. Thus, the antenna 100 in FIG. 1B has one more portion than that in FIG. 1A.

Figure 1C:
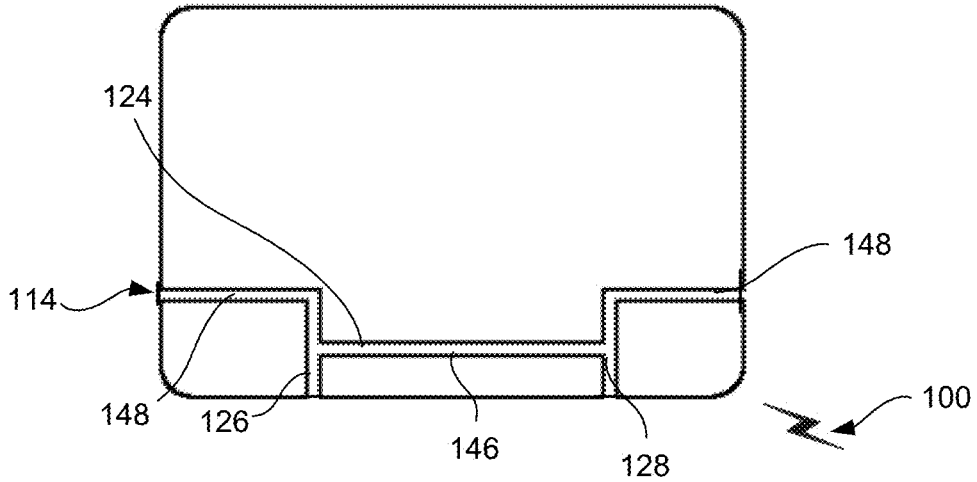
FIG. 1C illustrates the antenna of FIG. 1A with a zig-zag shaped slot, in accordance with another embodiment.

FIG. 1C illustrates the antenna 100 of FIG. 1A with a zig-zag shaped slot, in accordance with another embodiment. As an option, the version of the antenna 100 of FIG. 1C may be implemented with one or more features of any one or more of the embodiments set forth in any previous and/or subsequent figure(s) and/or the description thereof. However, it is to be appreciated that the version of the antenna 100 of FIG. 1C may be implemented in the context of any desired environment.

As illustrated, the slot 114 is zig-zag shaped. Specifically, in accordance with one embodiment, the first part 124 of the slot 114 may include a center 146 that resides along a first line while ends 148 reside along a second line that is spaced from and parallel to the first line. In other embodiments, the ends 148 may reside along separate lines (that may be spaced from and parallel to the first line) such that the ends 148 may reside at different heights. Further, the center 146 may extend between midpoints (or any other points) of the second part 126 and the third part 128 of the slot 114, and may, in other embodiments, extend above the aforementioned second line on which the ends 148 reside. While one specific embodiment is shown in FIG. 1C, it should be noted that the zig-zag may take any form where the first part 124, or any part, of the slot 114 is not simply linear, but rather is directed in one direction and/or another along a length thereof.

Figure 1D:
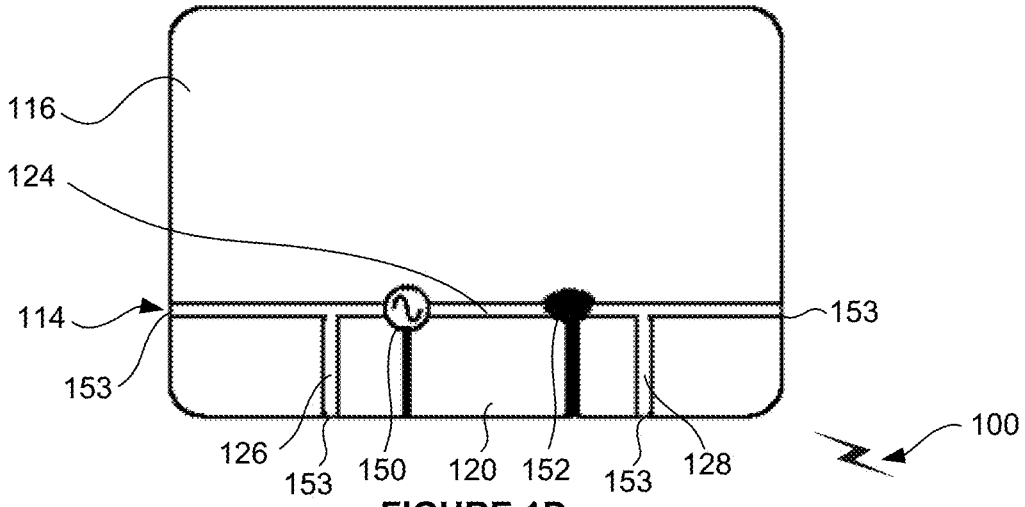
FIG. 1D illustrates the antenna of FIG. 1A with an antenna feed and a configurable element, in accordance with another embodiment.

FIG. 1D illustrates the antenna 100 of FIG. 1A with an antenna feed 150 and a configurable element 152, in accordance with another embodiment. As an option, the version of the antenna 100 of FIG. 1D may be implemented with one or more features of any one or more of the embodiments set forth in any previous and/or subsequent figure(s) and/or the description thereof. However, it is to be appreciated that the version of the antenna 100 of FIG. 1D may be implemented in the context of any desired environment. Specifically, it should be noted that, while the antenna feed 150 and the configurable element 152 are shown to be positioned in specific locations and operate in a certain manner in the present and some subsequent figures, such details are set forth for illustrative purposes only and should not be construed as limiting in any manner, as the antenna feed 150 and the configurable element 152 may be positioned along the slot 114 on any component of the antenna 100 in any number, and operate in any manner.

As shown, the antenna feed 150 [which includes at least one conductive piece (as shown) that terminates with a head (as also shown) at the slot 114] is positioned on the first part 124 of the slot 114 between the second part 126 and the third part 128 of the slot 114. In one embodiment, the antenna feed 150 may be positioned proximate to the second part 126 of the slot 114. Further, while not shown, it should be noted that the head of the antenna feed 150 includes a first contact in electrical communication with the first portion 116 of the antenna 100 and a second contact in electrical communication with the third portion 120 of the antenna 100 for applying positive and negative voltages thereto, respectively, or visa-versa. In other embodiments, such contacts may provide electrical communication between any desired portions of the antenna 100 (e.g. first portion 116, second portion 118, third portion 120, and/or fourth portion 122). In still additional embodiments, the at least one conductive piece may include a trace, a wire, a conductive extension, an extension finger, or any other conductive part; and may further extend to (and even terminate at) one of the upper portion 108 and the lower portion 110 of the periphery 106. In one embodiment, a configuration of the antenna feed 150 may be altered for the purpose of matching tuning (MT), for further configuring the antenna 100.

As further shown, the configurable element 152 [which includes at least one conductive piece (as shown) that terminates with a head (as also shown) at the slot 114] is also positioned on the first part 124 of the slot 114 between the second part 126 and the third part 128 of the slot 114. In one embodiment, the configurable element 152 may be positioned proximate to the third part 128 of the slot 114. Further, while not shown, it should be noted that the head of the configurable element 152 includes a first contact in electrical communication with the first portion 116 of the antenna 100 and a second contact in electrical communication with the third portion 120 of the antenna 100. In other embodiments, such contacts may provide electrical communication between any desired portions of the antenna 100 (e.g. first portion 116, second portion 118, third portion 120, and/or fourth portion 122). In still additional embodiments, the at least one conductive piece of the configurable element 152 may include a trace, a wire, a conductive extension, an extension finger, or any other conductive part; and may further extend to (and even terminate at) one of the upper portion 108 and the lower portion 110 of the periphery 106.

In one embodiment, the configurable element 152 may take the form of a switch. By this design, in use, the configurable element 152 is configured to be opened for preventing current from passing between the first portion 116 and the third portion 120 of the antenna 100. Further, the configurable element 152 is configured to be closed for allowing current to pass between the first portion 116 and the third portion 120 of the antenna 100. To this end, the antenna 100 is configured for operating in two modes including one when the element 152 is open, and another one when the element 152 is closed, so that the antenna 100 may accommodate the communication of signals at multiple frequency bands as required by some advanced cellular protocol standards such as 4G, LTE, LTE-A, 5G and further advancements thereof, etc.

It should be noted that, while the configurable element 152 is disclosed as being a switch capable of being opened and closed in the present embodiment, the configurable element 152 may operate with any two or more modes that allow different amounts of current to pass. Thus, the configurable element 152 may have N-states, where N=1, 2, 3 . . . any integer, etc. Further, the configurable element 152 may further include any type of element such as resistive, capacitive, inductive, another feed(s), or any combination thereof. Further, as will become apparent during the description of subsequent embodiments, the configurable element 152 may even be replaced/supplemented with fixed elements such as shunts, series, and/or a combination of both, etc.

In still additional embodiments, one or more ends 153 of the slot 114 may be electrically closed for further configuring the antenna 100. Such closure may be afforded by applying shunts and/or series components (not shown) across the end(s) 153, and/or by any other manufacturing technique that allows any desired amount of current to flow across the slot 114 at the end(s) 153. By this design, the selective closure of the end(s) 153 may be used for the purpose of aperture tuning (AT), for further configuring the antenna 100.

Figure 1E:
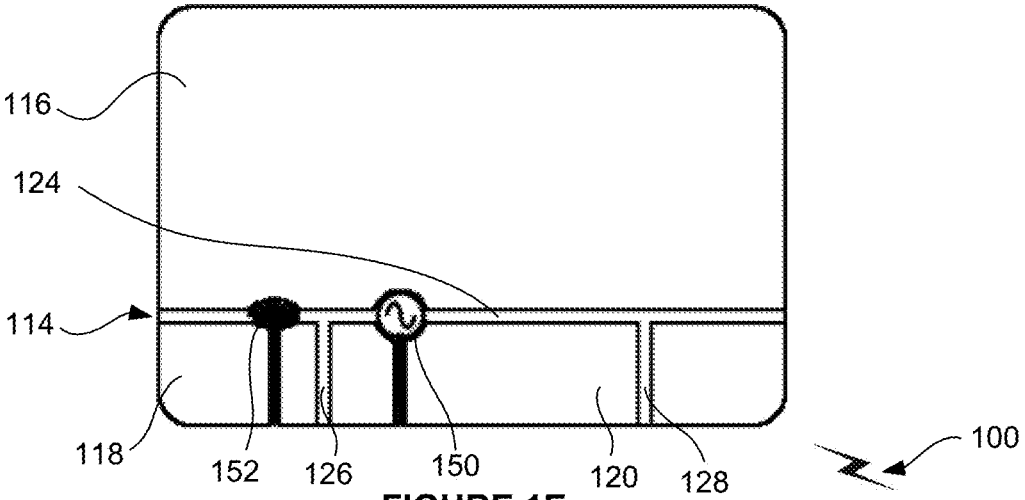
FIG. 1E illustrates the antenna of FIG. 1D with the antenna feed and the configurable element in a different location, in accordance with another embodiment.

FIG. 1E illustrates the antenna 100 of FIG. 1D with the antenna feed 150 and the configurable element 152 in a different location, in accordance with another embodiment. As an option, the version of the antenna 100 of FIG. 1E may be implemented with one or more features of any one or more of the embodiments set forth in any previous and/or subsequent figure(s) and/or the description thereof. However, it is to be appreciated that the version of the antenna 100 of FIG. 1E may be implemented in the context of any desired environment.

As shown, the antenna feed 150 is positioned on the first part 124 of the slot 114 between the second part 126 and the third part 128 of the slot 114. In one embodiment, the antenna feed 150 may be positioned proximate to the second part 126 of the slot 114. Further, while not shown, it should be noted that the antenna feed 150 includes a first contact in electrical communication with the first portion 116 of the antenna 100 and a second contact in electrical communication with the third portion 120 of the antenna 100 for applying positive and negative voltages thereto, respectively, or visa-versa.

In contrast to the embodiment of FIG. 1D, the configurable element 152 shown in FIG. 1E is positioned on the first part 124 of the slot 114 on a side of the second part 126 that is opposite of the antenna feed 150. Further, while not shown, it should be noted that the configurable element 152 includes a first contact in electrical communication with the first portion 116 of the antenna 100 and a second contact in electrical communication with the second portion 118 of the antenna 100.

In use, the configurable element 152 is configured to be opened for preventing current from passing between the first portion 116 and the second portion 118 of the antenna 100. Further, the configurable element 152 is configured to be closed for allowing current to pass between the first portion 116 and the second portion 118 of the antenna 100, so that the antenna 100 may accommodate the communication of signals at multiple frequency bands. As mentioned earlier, the configurable element 152 may take any form such as a switch, resistive/capacitive/inductive element, another feed(s), or any combination thereof that allows for any configurable amount(s) of current to flow therethrough, for enhancing the configurability of the antenna 100.

Figure 1F:
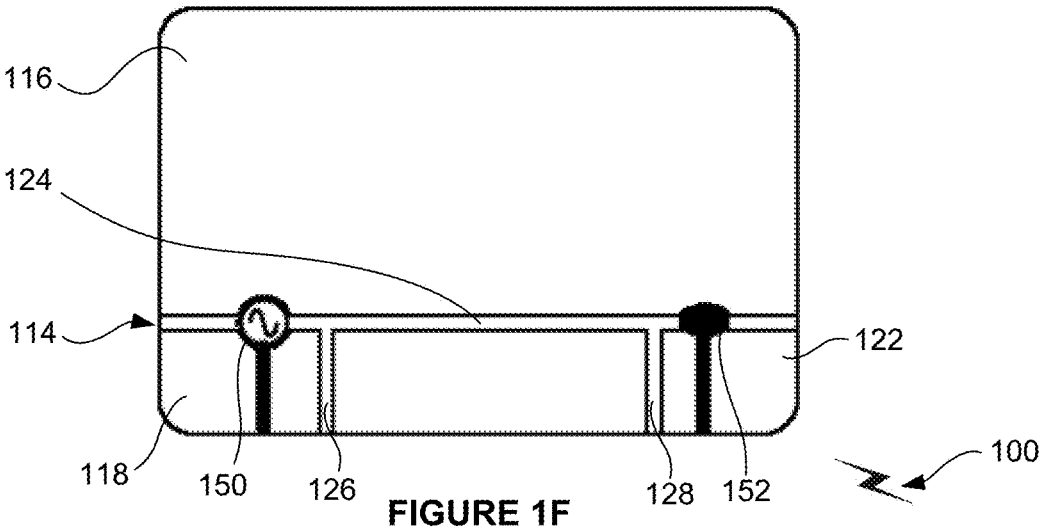
FIG. 1F illustrates the antenna of FIG. 1D with the antenna feed and the configurable element in yet another different location, in accordance with another embodiment.

FIG. 1F illustrates the antenna 100 of FIG. 1D with the antenna feed 150 and the configurable element 152 in yet another different location, in accordance with another embodiment. As an option, the version of the antenna 100 of FIG. 1F may be implemented with one or more features of any one or more of the embodiments set forth in any previous and/or subsequent figure(s) and/or the description thereof. However, it is to be appreciated that the version of the antenna 100 of FIG. 1F may be implemented in the context of any desired environment.

As shown, the antenna feed 150 is positioned on the first part 124 of the slot 114 adjacent to the second portion 118 of the antenna 100. In one embodiment, the antenna feed 150 may be positioned proximate to the second part 126 of the slot 114. Further, while not shown, it should be noted that the antenna feed 150 includes a first contact in electrical communication with the first portion 116 of the antenna 100 and a second contact in electrical communication with the second portion 118 of the antenna 100 for applying positive and negative voltages thereto, respectively, or visa-versa.

In contrast to the embodiments of FIG. 1C-1D, the configurable element 152 shown in FIG. 1F is positioned on the first part 124 of the slot 114 adjacent to the fourth portion 122 of the antenna 100. Further, the configurable element 152 may be positioned proximate to the third part 128 of the slot 114. While not shown, it should be noted that the configurable element 152 includes a first contact in electrical communication with the first portion 116 of the antenna 100 and a second contact in electrical communication with the fourth portion 122 of the antenna 100.

In use, the configurable element 152 is configured to be opened for preventing current from passing between the first portion 116 and the fourth portion 122 of the antenna 100. Further, the configurable element 152 is configured to be closed for allowing current to pass between the first portion 116 and the fourth portion 122 of the antenna 100. To this end, the antenna 100 is configured for operating in two modes, namely one when the element 152 is open, and another one when the element 152 is closed, so that the antenna 100 may accommodate the communication of signals at multiple frequency bands. Again, as mentioned earlier, the configurable element 152 may take any form such as a switch, resistive/capacitive/inductive element, another feed(s), any combination thereof that allows for any configurable amount(s) of current to flow therethrough, for enhancing the configurability of the antenna 100.

Figure 1G:
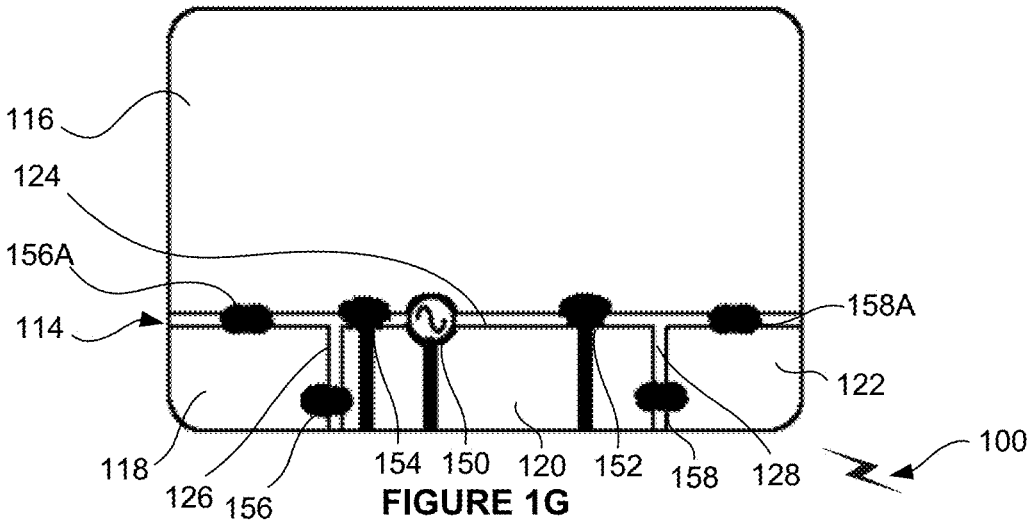
FIG. 1G illustrates the antenna of FIG. 1D with the antenna feed and additional configurable elements, in accordance with another embodiment.

FIG. 1G illustrates the antenna 100 of FIG. 1D with the antenna feed 150 and additional configurable elements, in accordance with another embodiment. As an option, the version of the antenna 100 of FIG. 1G may be implemented with one or more features of any one or more of the embodiments set forth in any previous and/or subsequent figure(s) and/or the description thereof. However, it is to be appreciated that the version of the antenna 100 of FIG. 1G may be implemented in the context of any desired environment.

Similar to the embodiment of FIG. 1D, the antenna feed 150 is positioned on the first part 124 of the slot 114 between the second part 126 and the third part 128 of the slot 114. In one embodiment, the antenna feed 150 may be positioned proximate to the second part 126 of the slot 114. Further, while not shown, it should be noted that the antenna feed 150 includes a first contact in electrical communication with the first portion 116 of the antenna 100 and a second contact in electrical communication with the third portion 120 of the antenna 100 for applying positive and negative voltages thereto, respectively, or visa-versa.

As further shown, the configurable element 152 is also positioned on the first part 124 of the slot 114 between the second part 126 and the third part 128 of the slot 114. Further, the configurable element 152 may be positioned proximate to the third part 128 of the slot 114. Further, while not shown, it should be noted that the configurable element 152 includes a first contact in electrical communication with the first portion 116 of the antenna 100 and a second contact in electrical communication with the third portion 120 of the antenna 100.

Further provided is an additional configurable element 154 that is also positioned on the first part 124 of the slot 114 between the second part 126 and the third part 128 of the slot 114. Such additional configurable element 154 may be positioned proximate to the second part 126 of the slot 114, adjacent to the antenna feed 150. Further, while not shown, it should be noted that the additional configurable element 154 includes a first contact in electrical communication with the first portion 116 of the antenna 100 and a second contact in electrical communication with the third portion 120 of the antenna 100. Also included are even additional configurable elements 156 and 158 positioned on the second part 126 of the slot 114 and the third part 128 of the slot 114, respectively. As shown, the additional configurable elements 156 and 158 may be positioned proximate to ends of the second part 126 and the third part 128 of the slot 114, respectively.

In use, each of the configurable elements 152, 154, 156, and 158 may be configured to be opened for preventing current from passing between the relevant portions of the antenna 100. Further, each of the configurable elements 152, 154, 156, and 158 may be configured to be closed for allowing current to pass between those same relevant portions of the antenna 100. To this end, the antenna 100 is configured for operating in a variety of modes each of which has a unique combination of the configurable elements 152, 154, 156, and 158 in either an open or closed status, so that the antenna 100 may accommodate the communication of signals at multiple frequency bands. Yet again, as mentioned earlier, the elements 152, 154, 156, and 158 may take any form such as a switch, resistive/capacitive/inductive element, another feed(s), any combination thereof that allows for any configurable amount(s) of current to flow therethrough, for enhancing the configurability of the antenna 100.

Further, in other embodiments, a position of any of the elements 152, 154, 156, and 158 may be adjusted, as desired. Just by way of example, the element 156 may be replaced or supplemented with a first element 156A in electrical communication with the first portion 116 and the second portion 118 of the antenna 100, and positioned on the first part 124 of the slot 114 adjacent to the second portion 118 of the antenna 100, for configuring the antenna 100. Further, the element 158 may be replaced or supplemented with a second element 158A in electrical communication with the first portion 116 and the fourth portion 122 of the antenna 100, and positioned on the first part 124 of the slot 114 adjacent to the fourth portion 122 of the antenna, for further configuring the antenna 100.

For example, in one embodiment, the antenna feed 150 may be supplemented with elements 156A, 158A in the form of additional feeds that may be simultaneously and/or independently used to excite any one or more of the portions 118, 120, 122 of the antenna 100. Still yet, the element 152 may take any form such as a switch, resistive/capacitive/inductive element, any combination thereof that allows for any configurable amount(s) of current to flow therethrough, for enhancing the configurability of the antenna 100. Further, while shown in specific locations in FIG. 1G, it should be noted that such elements 156A, 158A and configurable element 152 may be positioned in any desired location to accomplish this. Similar to that shown in FIG. 1D, one or more ends of the slot 114 may be electrically closed for further configuring the antenna 100. Such closure may be afforded by applying shunts and/or series (not shown) across the end(s), and/or by any other manufacturing technique that allows any desired amount of current to flow across the slot 114 at the end(s).

Figure 1H:
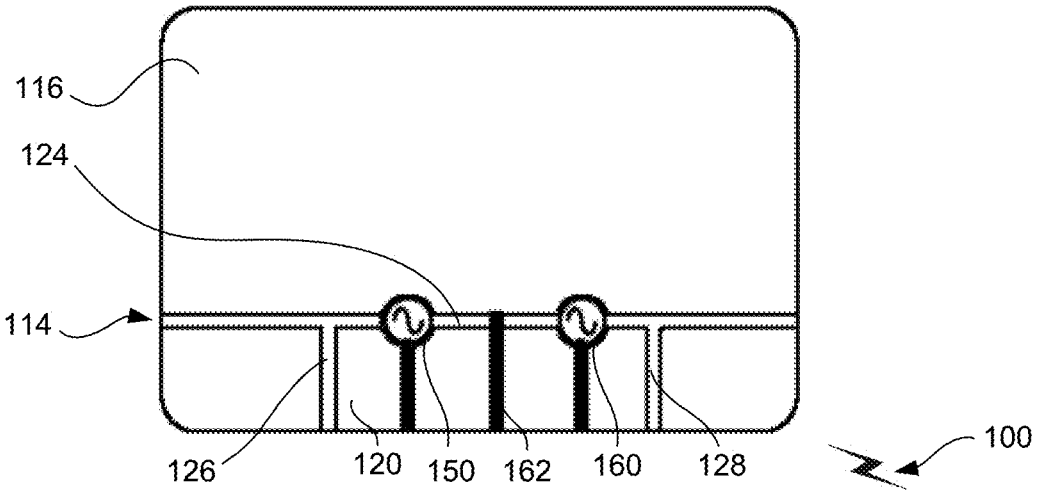
FIG. 1H illustrates the antenna of FIG. 1A with a first antenna feed and a second antenna feed, in accordance with another embodiment.

FIG. 1H illustrates the antenna 100 of FIG. 1A with a first antenna feed 150 and a second antenna feed 160, in accordance with another embodiment. As an option, the version of the antenna 100 of FIG. 1H may be implemented with one or more features of any one or more of the embodiments set forth in any previous and/or subsequent figure(s) and/or the description thereof. However, it is to be appreciated that the version of the antenna 100 of FIG. 1H may be implemented in the context of any desired environment.

Similar to the embodiment of FIG. 1D, the first antenna feed 150 is positioned on the first part 124 of the slot 114 between the second part 126 and the third part 128 of the slot 114. In one embodiment, the first antenna feed 150 may be positioned proximate to the second part 126 of the slot 114. Further, while not shown, it should be noted that the first antenna feed 150 includes a first contact in electrical communication with the first portion 116 of the antenna 100 and a second contact in electrical communication with the third portion 120 of the antenna 100 for applying positive and negative voltages thereto, respectively, or visa-versa.

As further shown, the additional second antenna feed 160 is also positioned on the first part 124 of the slot 114 between the second part 126 and the third part 128 of the slot 114. In contrast to the first antenna feed 150, the second antenna feed 160 may be positioned proximate to the third part 128 of the slot 114. Further, while not shown, it should be noted that the second antenna feed 160 includes a first contact in electrical communication with the first portion 116 of the antenna 100 and a second contact in electrical communication with the third portion 120 of the antenna 100 for applying positive and negative voltages thereto, respectively, or visa-versa.

With continuing reference to FIG. 1H, a fixed shunt 162 is positioned at a midpoint (or any other point) of the first part 124 of the slot 114 between the second part 126 and the third part 128 of the slot 114. The fixed shunt 162 includes a first contact in electrical communication with the first portion 116 of the antenna 100 and a second contact in electrical communication with the third portion 120 of the antenna 100 for allowing a limited amount of current to pass therebetween. In use, the antenna feeds 150, 160, and the fixed shunt 162 may be positioned, as shown, and used to operate as two separate antennas.

Figure 1I:
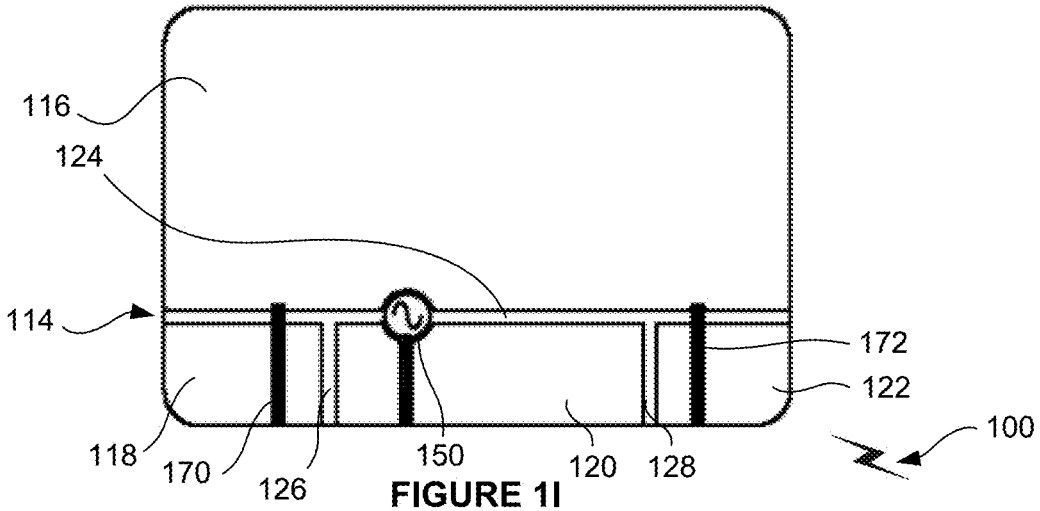
FIG. 1I illustrates the antenna of FIG. 1A with an antenna feed and multiple fixed shunts, in accordance with another embodiment.

FIG. 1I illustrates the antenna 100 of FIG. 1A with an antenna feed 150 and multiple fixed shunts, in accordance with another embodiment. As an option, the version of the antenna 100 of FIG. 1I may be implemented with one or more features of any one or more of the embodiments set forth in any previous and/or subsequent figure(s) and/or the description thereof. However, it is to be appreciated that the version of the antenna 100 of FIG. 1I may be implemented in the context of any desired environment.

Similar to the embodiment of FIG. 1D, the antenna feed 150 is positioned on the first part 124 of the slot 114 between the second part 126 and the third part 128 of the slot 114. In one embodiment, the antenna feed 150 may be positioned proximate to the second part 126 of the slot 114, as shown. Further, while not shown, it should be noted that the first antenna feed 150 includes a first contact in electrical communication with the first portion 116 of the antenna 100 and a second contact in electrical communication with the third portion 120 of the antenna 100 for applying positive and negative voltages thereto, respectively, or visa-versa.

As further shown, a first fixed shunt 170 is positioned on the first part 124 of the slot 114 on a side of the second part 126 of the slot 114 that is opposite of the antenna feed 150. Further, first fixed shunt 170 may be positioned proximate to the second part 126 of the slot 114, as shown. The first fixed shunt 170 includes a first contact in electrical communication with the first portion 116 of the antenna 100 and a second contact in electrical communication with the second portion 118 of the antenna 100 for allowing a limited amount of current to pass therebetween.

Further provided is a second fixed shunt 172 positioned on the first part 124 of the slot 114 on a side of the third part 128 of the slot 114 that is opposite of the antenna feed 150. Also, the second fixed shunt 172 may be positioned proximate to the third part 128 of the slot 114, as shown. The second fixed shunt 172 includes a first contact in electrical communication with the first portion 116 of the antenna 100 and a second contact in electrical communication with the fourth portion 122 of the antenna 100 for allowing a limited amount of current to pass therebetween. In use, the antenna feed 150, and the first and second fixed shunts 170, 172 may be positioned, as shown, and used to operate the antenna 100 with improved antenna performance.

Figure 1J:
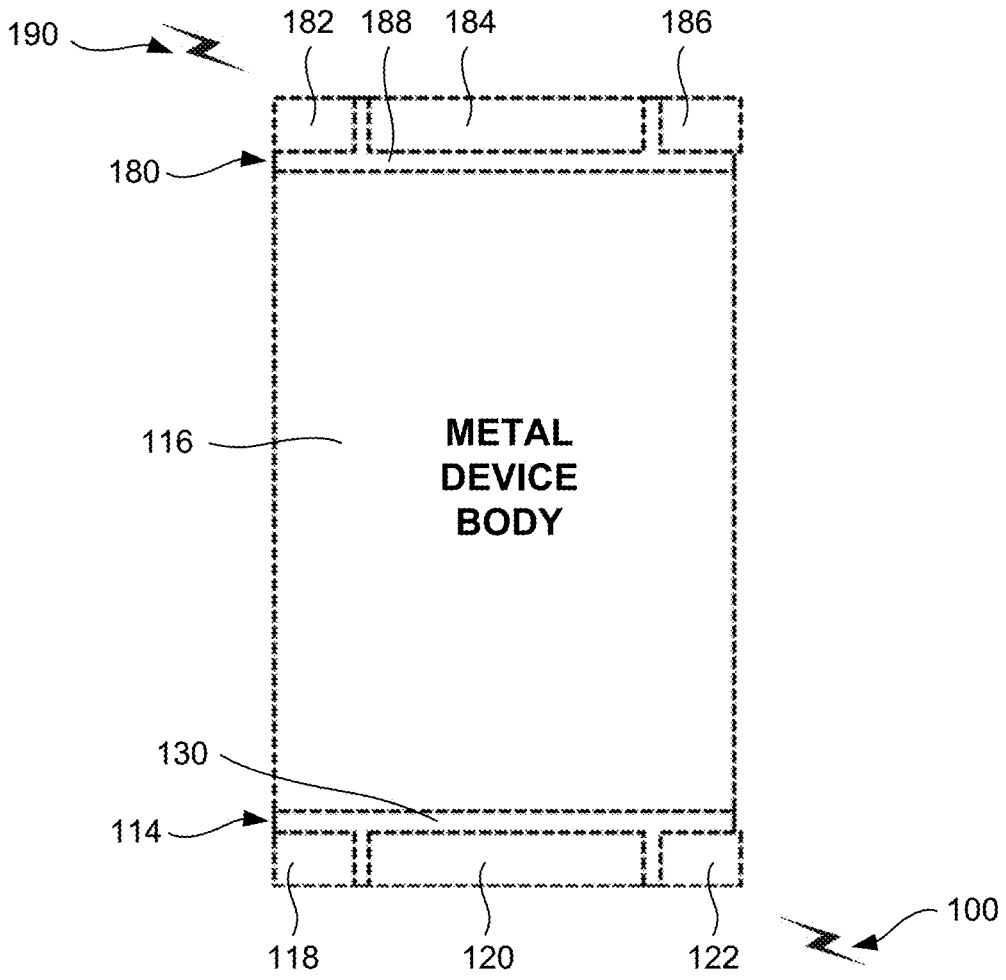
FIG. 1J illustrates the antenna of FIG. 1A with an additional slot thereby defining multiple antennas, in accordance with another embodiment.

FIG. 1J illustrates the antenna 100 of FIG. 1A with an additional slot 180 thereby defining multiple antennas whereby the antenna 100 include a first antenna that is supplemented by a second, additional antenna 190. As an option, the version of the antenna 100 of FIG. 1J may be implemented with one or more features of any one or more of the embodiments set forth in any previous and/or subsequent figure(s) and/or the description thereof. However, it is to be appreciated that the version of the antenna 100 of FIG. 1J may be implemented in the context of any desired environment.

As illustrated, the additional slot 180 forms an additional antenna 190 (i.e. a second antenna) so that the labeled metal device body and the additional antenna 190 includes a fifth portion 182, a sixth portion 184, and a seventh portion 186 that are defined by the additional slot 180. Further, additional dielectric 188 may be positioned in the additional slot 180 for providing continuous insulation between the fifth portion 182, the sixth portion 184, the seventh portion 186, and the first portion 116. It should be noted that the additional slot 180 and the additional dielectric 188 may or may not be constructed using any one or more of the features set forth hereinabove with respective to the slot 114 and/or dielectric 130. Further, the slots 114, 180 may even been interconnected such that the dielectric 130, 188 provides continuous insulation between any of the portions 116, 118, 120, 122, 182, 184, 186.

In the embodiment illustrated in FIG. 1J, the fifth portion 182, the sixth portion 184, the seventh portion 186, and the first portion 116 are configured for operating as an additional antenna 190 in a slot mode of operation. To this end, the antenna 100 and the additional antenna 190 may or may not be operated simultaneously in connection with the same or different antenna feeds/transceivers/wireless protocols. For example, in one embodiment, at least one switch (not shown) may be provided for switching between a first mode operation for utilizing the antenna 100, and a second mode operation for utilizing the additional antenna 190.

As mentioned earlier, any one or more features of FIGS. 1A-1J may be combined with any one or more other features of FIGS. 1A-1J and the positioning/tuning thereof may be adjusted, as well. Just by way of example, in one embodiment, the antenna feed 150 and the configurable element 152 of FIG. 1D may be supplemented with the additional configurable elements 156A and 158A of FIG. 1G. As described in the context of FIG. 1D, the one or more ends 153 of the slot 114 may be electrically closed for further configuring the antenna 100.

Figure 1K:
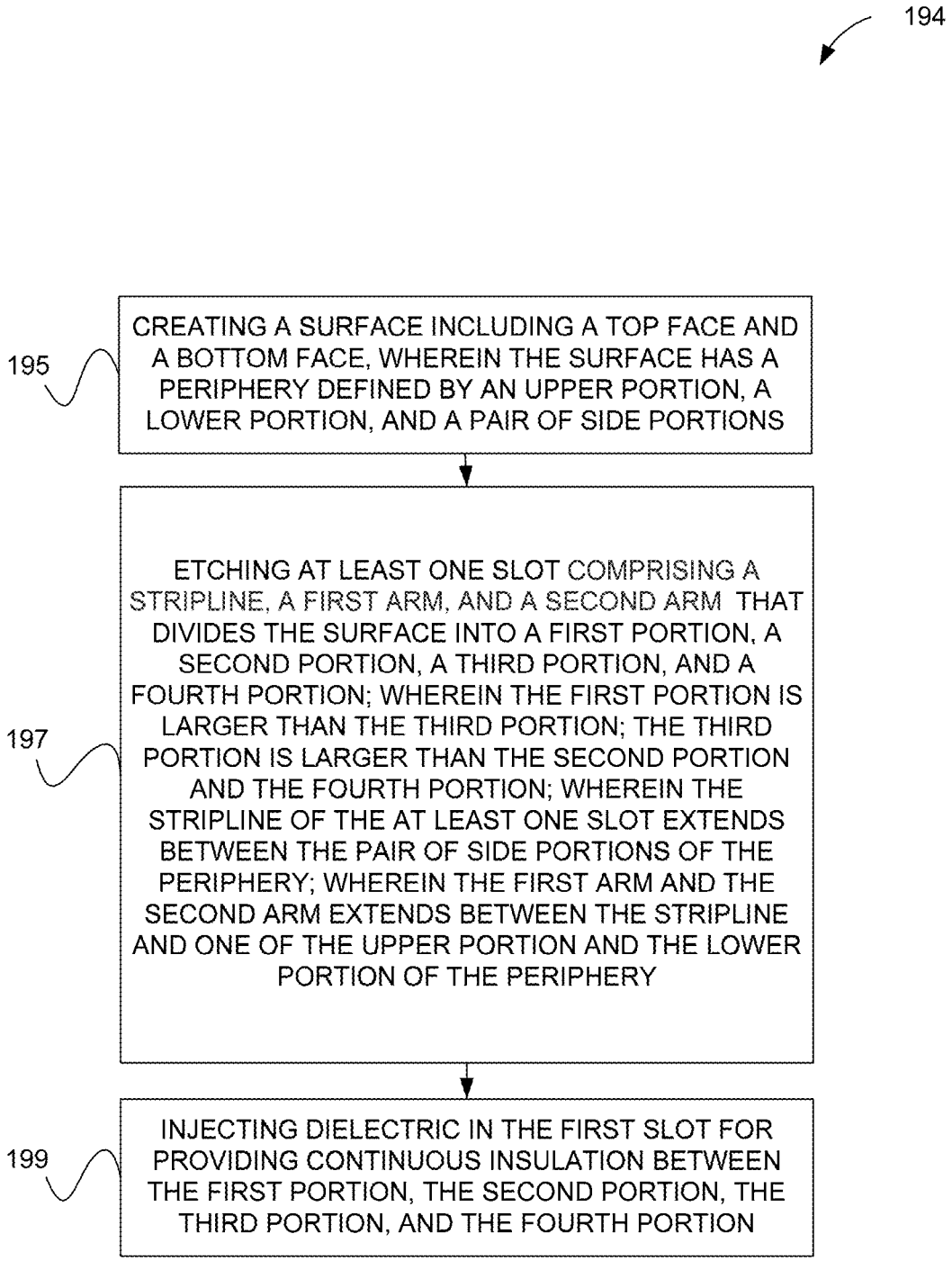
FIG. 1K illustrates a method for forming an antenna of an apparatus for wireless communication, in accordance with one embodiment.

FIG. 1K illustrates a method 194 for forming an antenna of an apparatus for wireless communication, in accordance with one embodiment. As an option, the method 194 may be implemented in the context of any one or more of the embodiments set forth in any previous and/or subsequent figure(s) and/or description thereof. However, it is to be appreciated that the method 194 may be implemented in the context of any desired environment.

As shown, in operation 195, a surface is created including a top face and a bottom face. Such surface has a periphery defined by an upper portion, a lower portion, and a pair of side portions. In various embodiments, such surface may include any one or more of the features described in the context of the embodiments of FIGS. 1A-1J. Further, the surface may be created in any desired manner including, but not limited to stamping, forming, or otherwise processing a piece of metal.

In operation 197, at least one slot is etched in the surface. Such slot includes a body, a first arm, and a second arm that divides the surface into a first portion, a second portion, a third portion, and a fourth portion. The first portion is larger than the third portion. Further, the third portion is larger than the second portion and the fourth portion. Still yet, the body of the slot extends between the pair of side portions of the periphery, and the first arm and the second arm extend between the body and one of the upper portion and the lower portion of the periphery. In various embodiments, the slot may further include any one or more of the features described in the context of the embodiments of FIGS. 1A-1J. Further, the slot may be etched in any desired manner including, but not limited to cutting or stamping the surface, or any other processing that results in the slot being formed.

With continuing reference to FIG. 1K, a dielectric is injected in the first slot, as indicated in operation 199, for providing continuous insulation between the first portion, the second portion, the third portion, and the fourth portion. In various embodiments, the dielectric may further include any one or more of the features described in the context of the embodiments of FIGS. 1A-1J. Still yet, the dielectric may be injected in any desired manner including, but not limited to depositing a moldable form of dielectric in the slot while the surface is held in a mold, inserting a pre-cut piece of dielectric into the slot, or any other processing that results in the placement of the dielectric in the first slot.

Figure 2A:
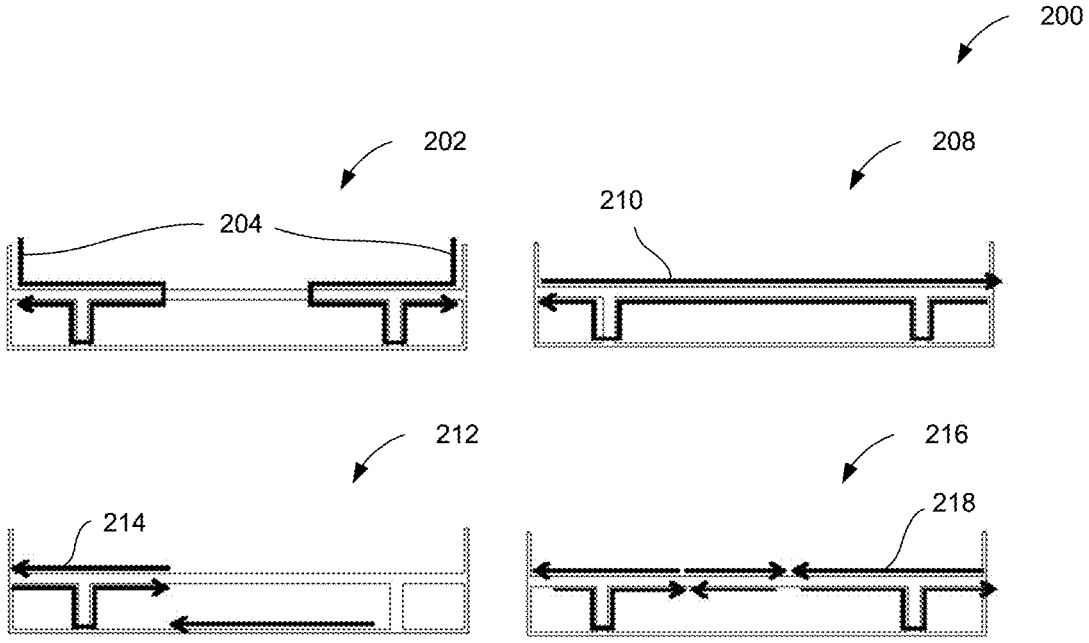
FIG. 2A illustrates different modes of operation of an antenna, in accordance with another embodiment.

FIG. 2A illustrates different modes of operation 200 of an antenna, in accordance with another embodiment. As an option, the different modes of operation 200 may be implemented in the context of any one or more of the embodiments set forth in any previous and/or subsequent figure(s) and/or description thereof. However, it is to be appreciated that the different modes of operation 200 may be implemented in the context of any desired environment.

As shown, a first mode of operation 202 is shown that operates at 700 MHz or, in other words, a quarter wavelength mode. In the first mode of operation 202, a first current 204 flows in the manner shown. As further shown, a second mode of operation 208 is shown that operates at 1800 MHz or, in other words, a half wavelength mode. In the second mode of operation 208, a second current 210 flows in the manner shown.

With continuing reference to FIG. 2A, a third mode of operation 212 is shown that operates at 2300 MHz or, in other words, a full wavelength mode. In the third mode of operation 212, a third current 214 flows in the manner shown. Finally, a fourth mode of operation 216 is shown that operates at 2700 MHz or, in other words, a full wavelength and a half mode. In the fourth mode of operation 216, a fourth current 218 flows in the manner shown.

Figure 2B:
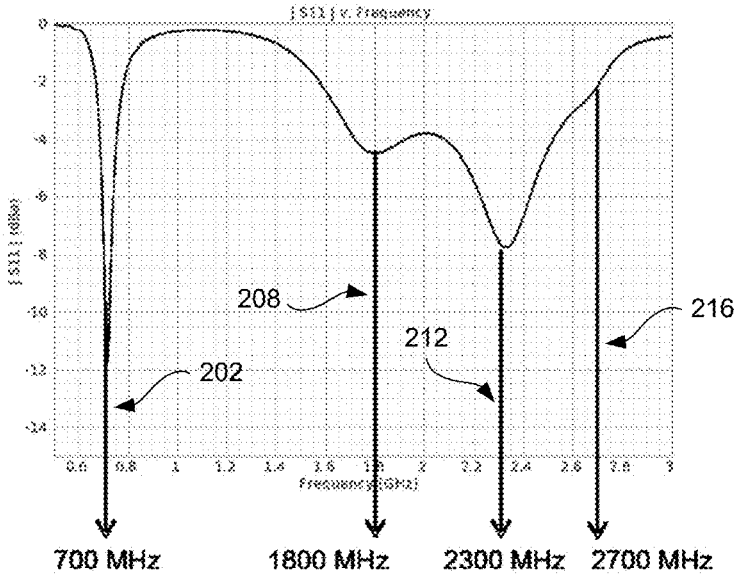
FIG. 2B illustrates an exemplary return loss in connection with each of the modes of operation shown in FIG. 2A, in accordance with one embodiment.

FIG. 2B illustrates an exemplary return loss 220 in connection with each of the modes of operation shown in FIG. 2A, in accordance with one embodiment. As shown, the first mode operation 202 is shown to involve a lower frequency band of operation, while the second, third and fourth modes of operation 208, 212, 216 are shown to involve higher frequency band modes of operation.

Figure 3A:
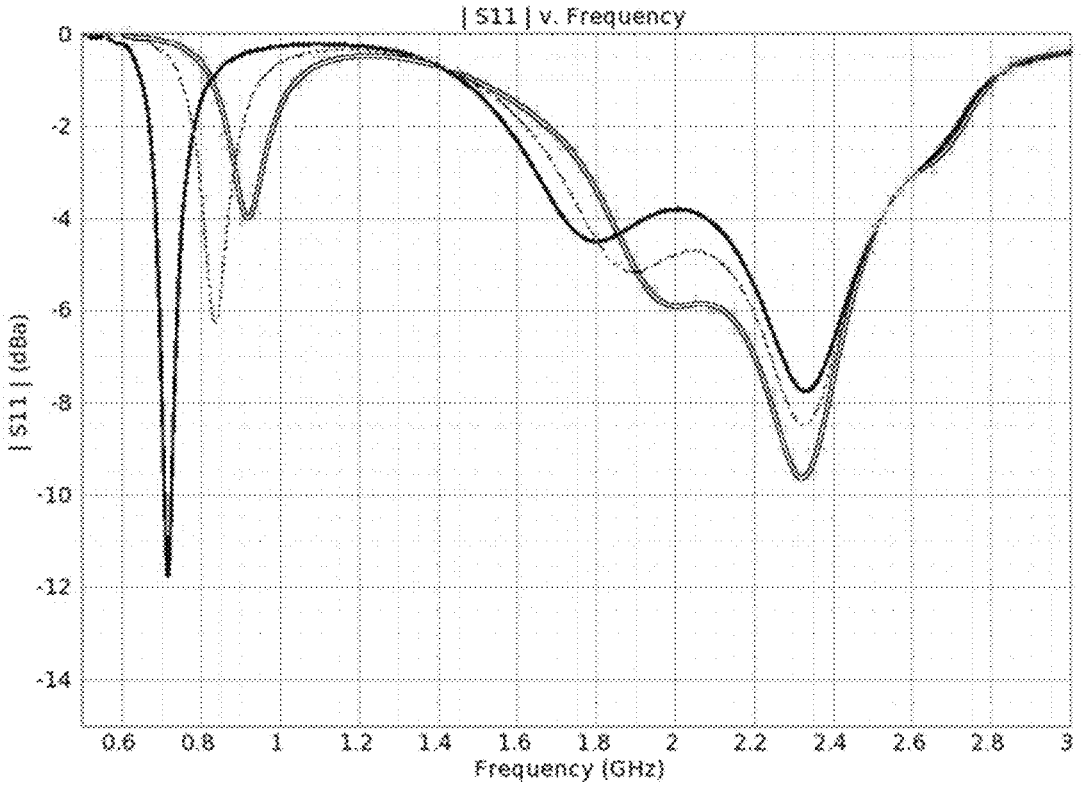
FIG. 3A illustrates an exemplary return loss in connection with operation of the embodiment of FIG. 1D, in accordance with one embodiment.

FIG. 3A illustrates an exemplary return loss 300 (|S11|) in connection with operation of the embodiment of FIG. 1D, in accordance with one embodiment. As illustrated, high frequency band performance is maintained, while the low frequency band is switched using any desired active components at any desired point. See, for example, the configurable element 152 of FIG. 1D.

|S11| is the magnitude of the logarithmic ratio of a reflected voltage to the transmitted voltage. Assuming one (1) volt of transmitted voltage and 0.5 volt of reflected voltage, then 0.5 volt of voltage is delivered to an antenna. Accordingly, 10*log 10 (0.5/1.0)=−3 dB. Therefore, the more negative the number, the less voltage is reflected, and the more energy (voltage squared) is delivered and radiated by the antenna. To this end, a larger negative number is indicative of better performance (i.e. more energy is accepted, and less energy is reflected back). Further, it should be noted that the different lines shown in FIG. 3A represent three different switching states of the antenna, as there is an RF switch that is switched during use to select an optimum operating condition for different low-band frequency bands. As evidenced by FIG. 3A, the antenna of the embodiment of FIG. 1D is capable of switching between three states, and all of such states exhibit desirable return loss.

Figure 3B:
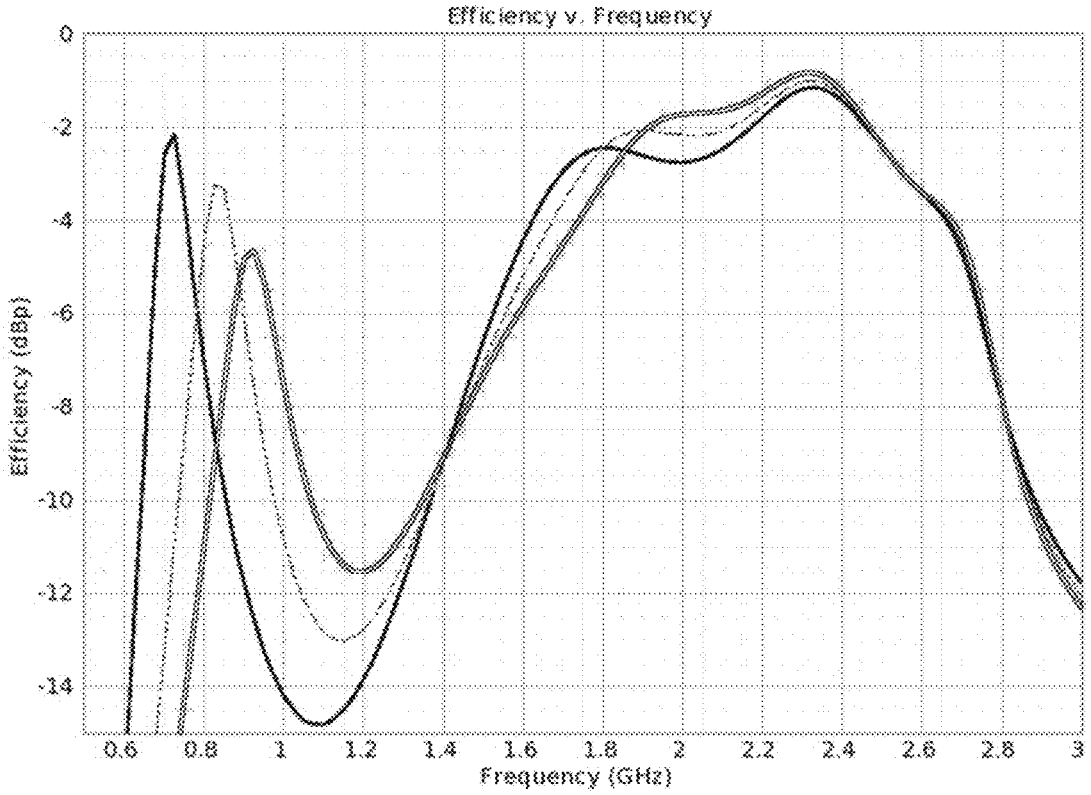
FIG. 3B illustrates an exemplary antenna efficiency that is exhibited in connection with operation of the embodiment of FIG. 1D, in accordance with one embodiment.

FIG. 3B illustrates an exemplary antenna efficiency 302 that is exhibited in connection with operation of the embodiment of FIG. 1D, in accordance with one embodiment. The efficiency of the antenna is measured by an amount of energy (voltage squared) received at the receiving antenna over air, divided by an amount of energy transmitted to the antenna. This is thus an overall test because the energy is transported to the antenna port, radiated by the transmitting antenna, propagated as electromagnetic waves through the air, received by the receiving antenna, and converted back to current on the receiving antenna ports. While the transmitting antenna is transmitting, the receiving antenna will collect a 3-dimensional radiation pattern, and then aggregate the data. Assuming half the transmitted power is received, then, 10*log 10 (0.5/1.0)=−3 dB. To this end, a larger negative number is indicative of better performance (i.e. more energy is being delivered from one antenna to another). Similar to FIG. 3A, it should be noted that the different lines shown in FIG. 3B represent different switching states of the antenna, as there is an RF switch that is switched during use to select an optimum operating condition for different low-band frequency bands. As evidenced by FIG. 3B, the antenna of the embodiment of FIG. 1D is capable of transmitting (in each state) the energy to the air, with little energy being lost as heat, etc.

In one possible embodiment, an antenna is provided with a slot means for dividing the antenna into a first portion, a second portion, a third portion, and a fourth portion. Such slot means may, for example, include any version of the slot 114 shown in FIGS. 1A-1J, etc. Further, provided is a dielectric means for providing continuous insulation between the first portion, the second portion, the third portion, and the fourth portion. Such dielectric means may, for example, include any version of the dielectric 130 shown in FIGS. 1A-1J, etc. Still yet, circuitry means is provided for operating the mobile device housing as an antenna in a slot mode of operation. Such circuitry means may, for example, include one or more processors, transceivers, etc.

To this end, in some optional embodiments, the slot/dielectric may provide an antenna that works well in connection with metallically-housed mobile devices without requiring one or more externally protruding antennas, while accommodating requirements of modern cellular communication standards including, but not limited to multiple-input-multiple output (MIMO) antenna configurations, carrier aggregation (CA) capabilities, etc. By its design, the antenna may serve to overcome various challenges in designing mobile device antennas to accommodate the foregoing design considerations.

Figure 4:
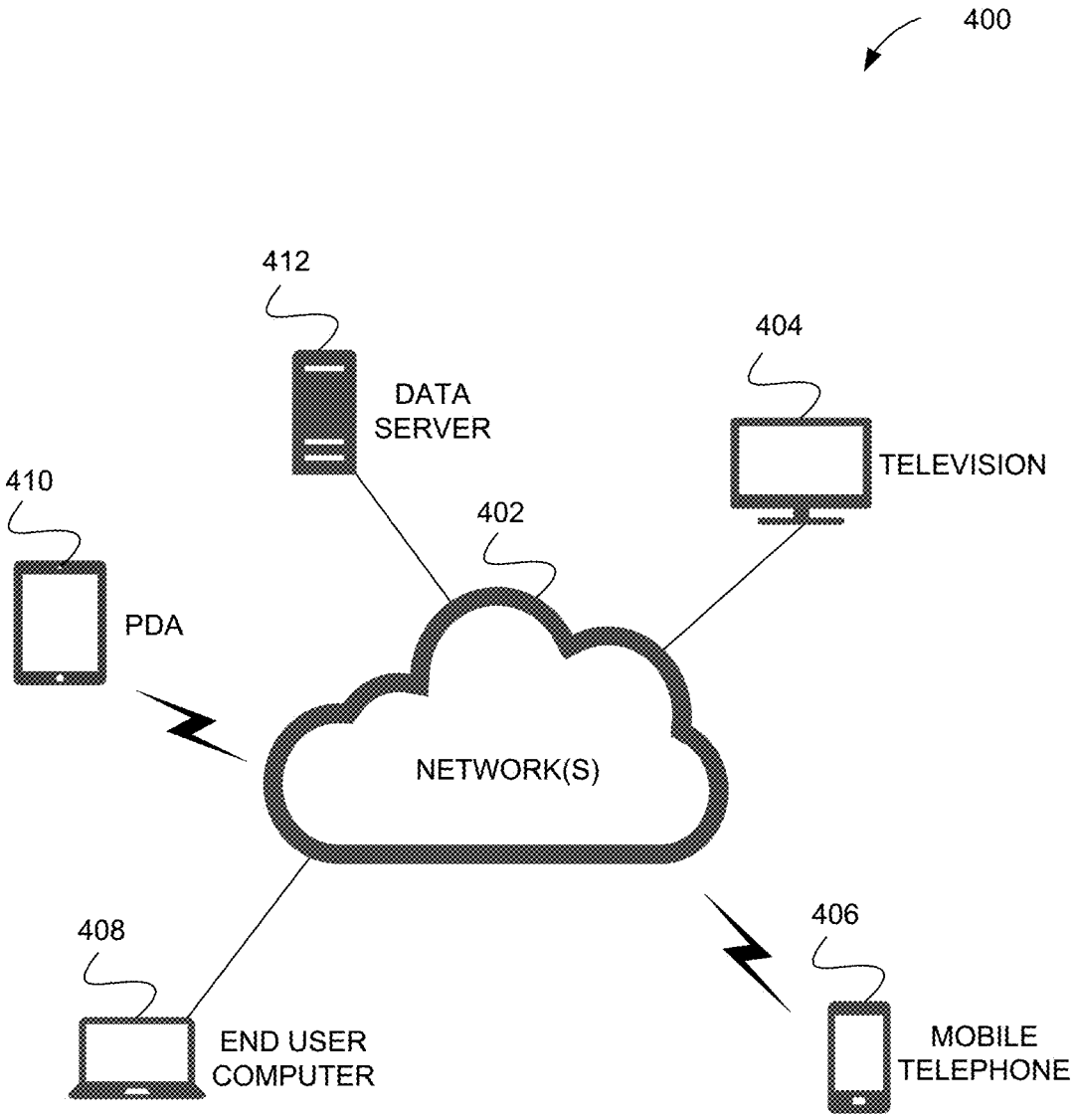
FIG. 4 illustrates a network architecture, in accordance with one embodiment.

FIG. 4 illustrates a network architecture 400, in accordance with one embodiment. In one embodiment, the aforementioned antenna and other components may be implemented in the context of any of the portable devices displayed in FIG. 4. Of course, such embodiment is set forth for illustrative purposes and should not be construed as limiting in any manner.

As shown, at least one network 402 is provided. In the context of the present network architecture 400, the network 402 may take any form including, but not limited to a telecommunications network, a local area network (LAN), a wireless network, a wide area network (WAN) such as the Internet, peer-to-peer network, cable network, etc. While only one network is shown, it should be understood that two or more similar or different networks 402 may be provided.

Coupled to the network 402 is a plurality of devices. For example, a server computer 412 and an end user computer 408 may be coupled to the network 402 for communication purposes. Such end user computer 408 may include a desktop computer, lap-top computer, and/or any other type of logic. Still yet, various other devices may be coupled to the network 402 including a personal digital assistant (PDA) device 410, a mobile phone device 406, a television 404, etc.

Figure 5:
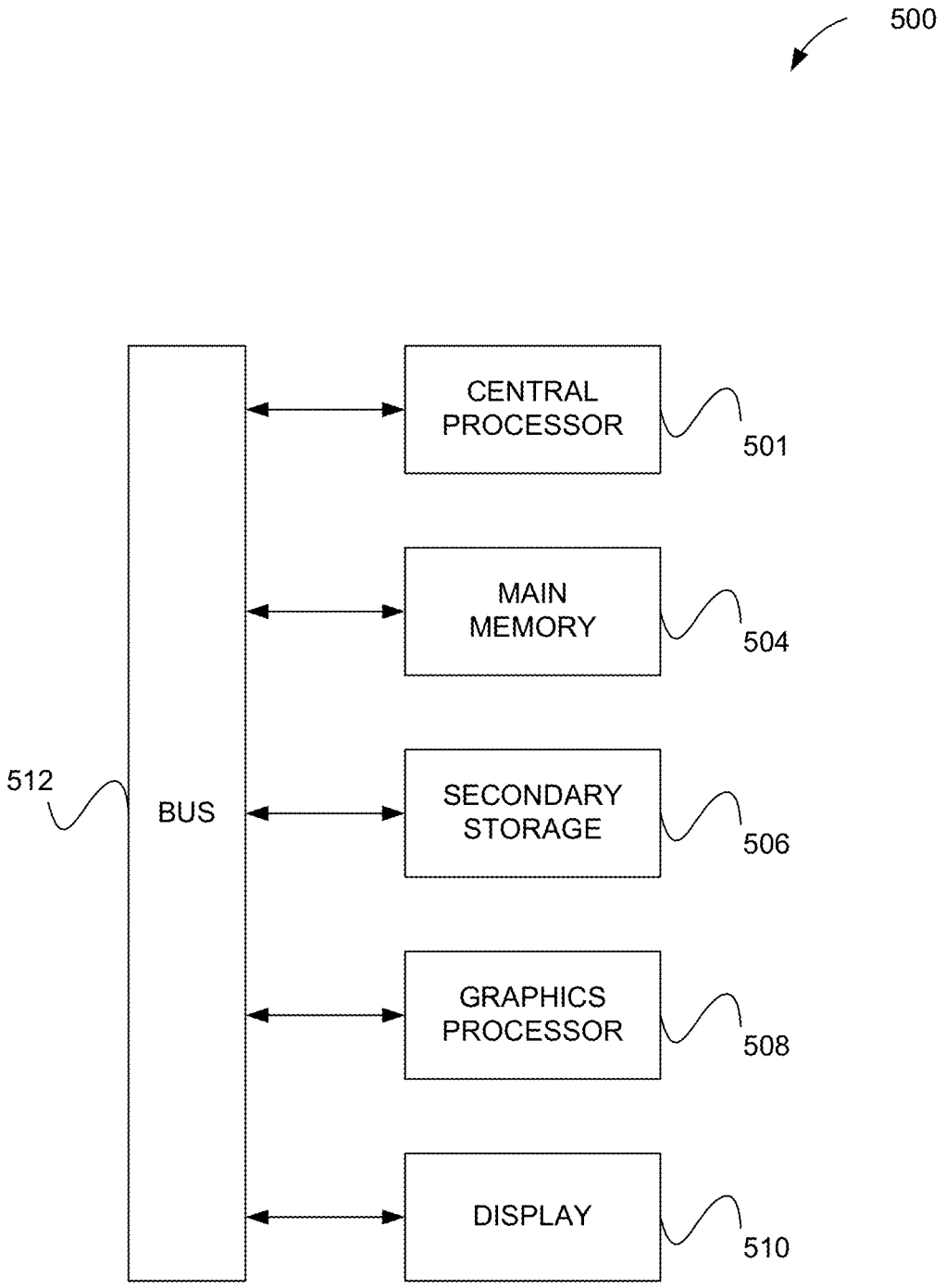
FIG. 5 illustrates an exemplary system, in accordance with one embodiment.

FIG. 5 illustrates an exemplary system 500, in accordance with one embodiment. As an option, the system 500 may be implemented in the context of any of the devices of the network architecture 400 of FIG. 4. However, it is to be appreciated that the system 500 may be implemented in any desired environment.

As shown, a system 500 is provided including at least one central processor 502 which is connected to a bus 512. The system 500 also includes main memory 504 such as a hard disk drive, solid state drive, random access memory (RAM), etc. The system 500 also includes a graphics processor 508 and a display 510.

The system 500 may also include a secondary storage 506. The secondary storage 506 includes, for example, a hard disk drive and/or a removable storage drive, representing a floppy disk drive, a magnetic tape drive, a compact disk drive, etc. The removable storage drive reads from and/or writes to a removable storage unit in a well-known manner.

Computer programs, or computer control logic algorithms, may be stored in the main memory 504, the secondary storage 506, and/or any other memory, for that matter. Such computer programs, when executed, enable the system 500 to perform various functions (as set forth above, for example). Memory 504, secondary storage 506 and/or any other storage are possible examples of non-transitory computer-readable media.

It should be understood that the arrangement of components illustrated in the Figures described are exemplary and that other arrangements are possible. It should also be understood that the various system components (and means) defined by the claims, described below, and illustrated in the various block diagrams represent logical components in some systems configured according to the subject matter disclosed herein.

For example, one or more of these system components (and means) may be realized, in whole or in part, by at least some of the components illustrated in the arrangements illustrated in the described Figures. In addition, while at least one of these components are implemented at least partially as an electronic hardware component, and therefore constitutes a machine, the other components may be implemented in software that when included in an execution environment constitutes a machine, hardware, or a combination of software and hardware.

More particularly, at least one component defined by the claims is implemented at least partially as an electronic hardware component, such as an instruction execution machine in the form of a processor-based or processor-containing machine, and/or as specialized circuits or circuitry such as discreet logic gates interconnected to perform a specialized function. Other components may be implemented in software, hardware, or a combination of software and hardware. Moreover, some or all of these other components may be combined, some may be omitted altogether, and additional components may be added while still achieving the functionality described herein. Thus, the subject matter described herein may be embodied in many different variations, and all such variations are contemplated to be within the scope of what is claimed.

In the description above, the subject matter is described with reference to acts and symbolic representations of operations that are performed by one or more devices, unless indicated otherwise. As such, it will be understood that such acts and operations, which are at times referred to as being computer-executed, include the manipulation by the processor of data in a structured form. This manipulation transforms the data or maintains it at locations in the memory system of the computer, which reconfigures or otherwise alters the operation of the device in a manner well understood by those skilled in the art. The data is maintained at physical locations of the memory as data structures that have particular properties defined by the format of the data. However, while the subject matter is being described in the foregoing context, it is not meant to be limiting as those of skill in the art will appreciate that various of the acts and operations described hereinafter may also be implemented in hardware.

To facilitate an understanding of the subject matter described herein, many aspects are described in terms of sequences of actions. At least one of these aspects defined by the claims is performed by an electronic hardware component. For example, it will be recognized that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language ("such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations such as from about 1 to about 10 includes, 2, 3, 4, etc.; greater than 0.10 includes 0.11, 0.12, 0.13, etc. For example, whenever a numerical range with a lower limit, R.sub.1, and an upper limit, Ru, is disclosed, any number falling within the range is specifically disclosed. In particular, the following numbers within the range are specifically disclosed: R=R.sub.1+k*(R.sub.u−R.sub.1), wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . . , 97 percent, 96 percent, 97 percent, 98 percent, 99 percent, or 100 percent. Moreover, any numerical range defined by two R numbers as defined in the above is also specifically disclosed. The use of the term "about" means .+−.10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

The embodiments described herein include the one or more modes known to the inventor for carrying out the claimed subject matter. It is to be appreciated that variations of those embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. An apparatus that provides a housing for a mobile device, comprising:

a first antenna comprising:

a top face;

a bottom face;

a periphery defined by an upper portion, a lower portion, and a pair of side portions;

a first slot on the top face, wherein the first slot comprises a body, a first arm, and a second arm that divides the first antenna into a first portion, a second portion, a third portion, and a fourth portion;

wherein the first portion is larger than the third portion, and the third portion is larger than the second portion and the fourth portion;

wherein the body of the first slot extends between the side portions of the periphery;

wherein the first arm and the second arm extend between the body and one of the upper portion and the lower portion of the periphery;

wherein the first slot comprises a third arm that divides the third portion into two portions; and dielectric positioned in the first slot for providing continuous insulation between the first portion, the second portion, the third portion, and the fourth portion.

2. The apparatus of claim 1, wherein the first portion is formed between the body, the upper portion and the pair of side portions of the periphery; the second portion is formed between the body, the first arm, the lower portion and one of the pair of side portions of the periphery; the third portion is formed between the body, the first arm, the second arm and the lower portion of the periphery; and the fourth portion is formed between the body, the second arm, the lower portion and the other of the pair of side portion of the periphery.

3. The apparatus of claim 1, wherein the body of the first slot is linear.

4. The apparatus of claim 1, and further comprising:

a second antenna comprising:

a second slot comprising a second body, a fourth arm, and a fifth arm that divides the second antenna into a first portion, a fifth portion, a sixth portion, and a seventh portion;

wherein the first portion is larger than the sixth portion, and the sixth portion is larger than the fifth portion and the seventh portion;

wherein the second body of the second slot extends between the side portions of the periphery;

wherein the fourth arm and the fifth arm extend between the body and the other of the upper portion and the lower portion of the periphery which is opposite to the one to which the first arm and the second arm extend; and dielectric positioned in the second slot for providing continuous insulation between the first portion, the fifth portion, the sixth portion, and the seventh portion.

5. The apparatus of claim 4, further comprising at least one switch for switching between a first mode operation for utilizing the first antenna, and a second mode operation for utilizing the second antenna.

6. The apparatus of claim 1, wherein the first portion has a surface area that is 2 to 50 times of a surface of the second portion.

7. The apparatus of claim 1, wherein the apparatus is configured for operating the first antenna in a higher frequency band mode and a lower frequency band mode.

8. The apparatus of claim 1, wherein the third portion has a surface area that is equal or bigger than a total surface of the second portion and the fourth portion.

9. The apparatus of claim 1, wherein the first slot has a width between 0.5-3.0 mm.

10. The apparatus of claim 1, wherein one or more ends of the slot are electrically closed.

11. The apparatus of claim 1, further comprising:

at least one fixed element in electrical communication with at least two of the first portion, the second portion, the third portion, and the fourth portion; and at least one antenna feed in electrical communication with at least two of the first portion, the second portion, the third portion, and the fourth portion.

12. The apparatus of claim 11, wherein the fixed element includes at least one of a resistive element, a capacitive element, and an inductive element.

13. The apparatus of claim 11, wherein the at least one fixed element includes a fixed shunt.

14. The apparatus of claim 11, wherein each of the at least one antenna feed comprising a head and a conductive piece;

wherein the head of the antenna feed electrically communicates between the first portion and at least one of the second portion, the third portion and the fourth portion; and wherein the conductive piece of the antenna feed extends from the head of the antenna feed.

15. The apparatus of claim 1, further comprising:

at least one configurable element in electrical communication with at least two of the first portion, the second portion, the third portion, and the fourth portion; and at least one antenna feed in electrical communication with at least two of the first portion, the second portion, the third portion, and the fourth portion.

16. The apparatus of claim 15, wherein the at least one configurable element includes at least one of a resistive element, a capacitive element, and an inductive element.

17. The apparatus of claim 15, wherein the configurable element includes a switch.

18. The apparatus of claim 15, wherein each of the at least one configurable element comprises a head electrically communicates between at least two of the first portion, the second portion, the third portion and the fourth portion.

19. The apparatus of claim 18, wherein one of the at least one configurable element comprises a conductive piece that extends from the head of the configurable element.

20. The apparatus of claim 15, wherein each of the at least one antenna feed comprising a head and a conductive piece;

wherein the head of the antenna feed electrically communicates between the first portion and at least one of the second portion, the third portion and the fourth portion; and wherein the conductive piece of the antenna feed extends from the head of the antenna feed.

21. The apparatus of claim 1, wherein the body of the first slot is non-linear.

22. A method for forming an antenna of an apparatus for housing a mobile device, the method comprising:

creating a surface including a top face and a bottom face, wherein the surface has a periphery defined by an upper portion, a lower portion, and a pair of side portions;

etching at least one slot on the top face, wherein the at least one slot comprises a body, a first arm, and a second arm that divides the surface into a first portion, a second portion, a third portion, and a fourth portion; wherein the first portion is larger than the third portion; the third portion is larger than the second portion and the fourth portion; wherein the body of the at least one slot extends between the pair of side portions of the periphery; wherein the first arm and the second arm extend between the body and one of the upper portion and the lower portion of the periphery; wherein the at least one slot comprises a third arm that divides the third portion into two portions; and injecting a dielectric in the slot for providing continuous insulation between the first portion, the second portion, the third portion, and the fourth portion.

* * * * *